US008490833B2

(12) United States Patent
van der Heijden

(10) Patent No.: US 8,490,833 B2
(45) Date of Patent: Jul. 23, 2013

(54) DISPENSING DEVICE

(75) Inventor: Edgar Ivo Maria van der Heijden, Broek op Langedijk (NL)

(73) Assignee: Airspray N.V., Alkmaar (NL)

( * ) Notice: Subject to any disclaimer, the term of this patent is extended or adjusted under 35 U.S.C. 154(b) by 592 days.

(21) Appl. No.: 11/587,896

(22) PCT Filed: Mar. 31, 2005

(86) PCT No.: PCT/NL2005/000233

§ 371 (c)(1),
(2), (4) Date: Jan. 23, 2007

(87) PCT Pub. No.: WO2005/105320

PCT Pub. Date: Nov. 10, 2005

(65) Prior Publication Data

US 2007/0215642 A1 Sep. 20, 2007

(30) Foreign Application Priority Data

Apr. 29, 2004 (NL) ..... 1026093

(51) Int. Cl.
*B67D 1/16* (2006.01)

(52) U.S. Cl.
USPC ..... 222/108; 222/190

(58) Field of Classification Search
USPC ..... 222/108, 190, 109, 111; 239/106, 239/110
See application file for complete search history.

(56) References Cited

U.S. PATENT DOCUMENTS

| | | | | |
|---|---|---|---|---|
| 4,739,904 | A * | 4/1988 | Spencer et al. | 222/109 |
| 6,536,629 | B2 * | 3/2003 | van der Heijden | 222/190 |
| 2001/0054621 | A1 * | 12/2001 | Weber | 222/108 |

FOREIGN PATENT DOCUMENTS

| | | | |
|---|---|---|---|
| EP | 1 057 739 | A2 | 12/2000 |
| JP | 09077115 | A * | 3/1997 |
| WO | WO 00/78629 | A1 | 12/2000 |

* cited by examiner

*Primary Examiner* — Kevin P Shaver
*Assistant Examiner* — Daniel R Shearer
(74) *Attorney, Agent, or Firm* — Hoffmann & Baron, LLP

(57) ABSTRACT

The invention relates to a dispensing device for dispensing a liquid, in particular in the form of a foam, at least comprising a liquid container and a dispensing assembly, the dispensing assembly comprising a liquid pump (4) and an actuating head (10). The actuating head comprises a discharge duct (12) and a dispensing opening for dispensing the liquid, and a circular protective cap (14), which protective cap can be guided into a space which is formed between a protective inner wall (29) and a protective outer wall (30) the dispensing assembly. One or more discharge openings (31) are provided near the bottom of the space which discharge to the outside. According to a first aspect of the invention, the one or more discharge openings discharge over a section (30A) of at most 180 degrees, preferably at most 90 degrees, of the periphery of the dispensing device. According to a second aspect of the invention, a retaining handle is formed by a retaining section of the protective outer wall (30) the dispensing device, which section is substantially vertical and/or tapers outwards in the direction remote from the liquid container.

14 Claims, 2 Drawing Sheets

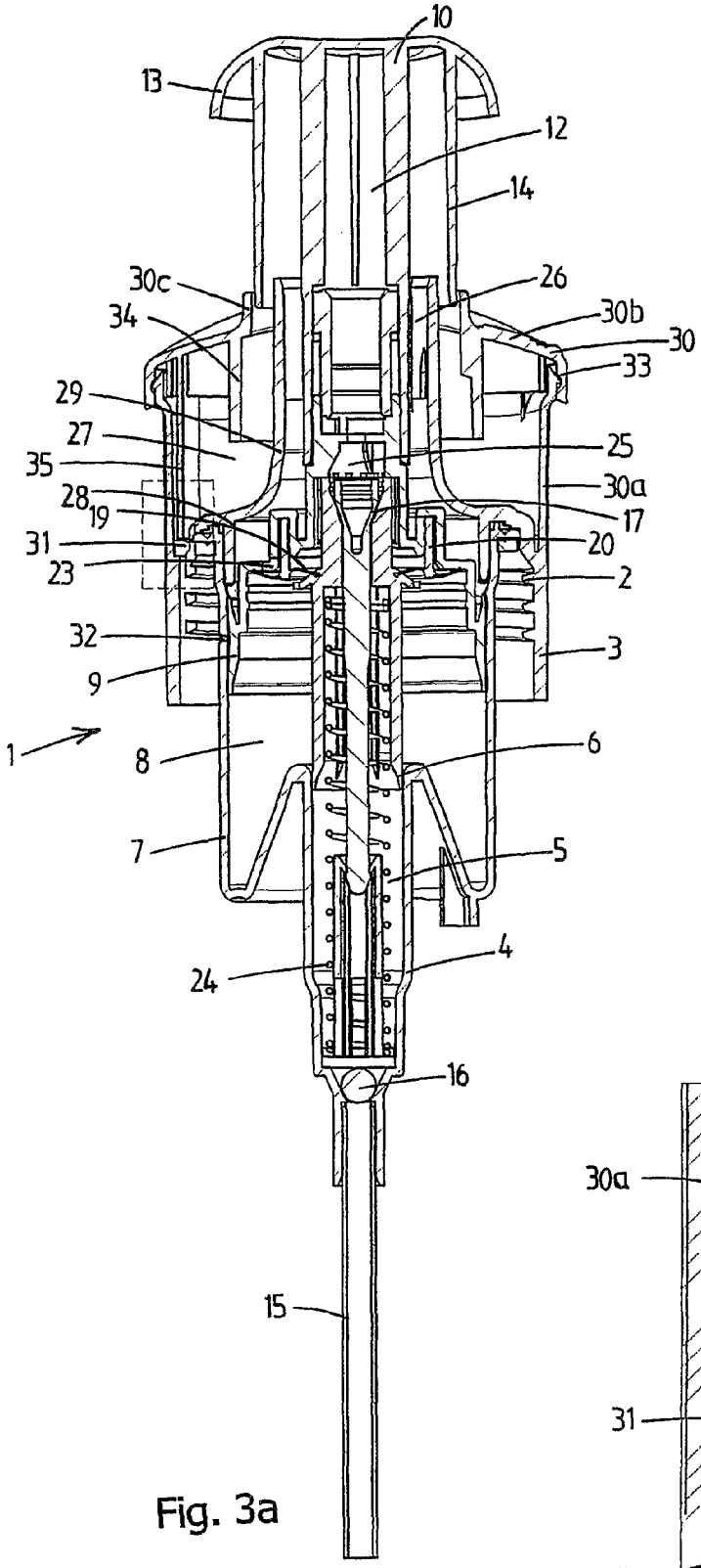
Fig. 3a
Fig. 3b
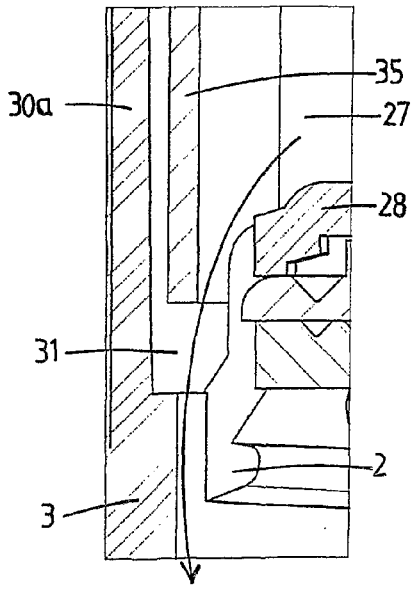

DISPENSING DEVICE

CROSS-REFERENCE TO RELATED APPLICATIONS:

This application is the National Stage of International Application No. PCT/NL2005/000233, filed Mar. 31, 2005, which claims the benefit of Netherlands Application No. NL 1026093, filed Apr. 29, 2004, the contents of which is incorporated by reference herein.

FIELD OF THE INVENTION:

The invention relates to a dispensing device for dispensing a liquid, in particular in the form of a foam, at least comprising a liquid container and a dispensing assembly, the dispensing assembly comprising a liquid pump and an actuating head, the actuating head comprising a discharge duct and a dispensing opening for dispensing the liquid, and a circular protective cap, which protective cap can be guided into a space which is formed between a protective inner wall and a protective outer wall of the dispensing assembly, one or more discharge openings being provided near the bottom of the space which discharge to the outside.

BACKGROUND OF THE INVENTION:

A dispensing device is known from WO 00/78629.

Dispensing devices of the type mentioned in the introduction are used inter alia for dispensing liquids, such as toothpaste, gel, etc. There are also dispensing devices which are intended for dispensing atomized air-liquid mixtures, such as deodorant, hair strengthening products, paint, etc. This last type of dispensing device may, however, also comprise foam-forming means, so that the dispensing device is suitable for dispensing foam products, such as shaving foam, soap, shower foam, etc.

In the context of the present invention, liquid is understood to mean both low-viscosity liquids and viscous liquids and pasty materials.

The dispensing device according to WO 00/78629 is protected against the ingress of water by providing the actuating head with a protective cap which is guided into a space in the dispensing device. The water which still enters the space between the protective cap and the actuating head, can be discharged through one or more discharge openings provided in the bottom of the space and discharging to the outer wall of the dispensing device.

One drawback of the known dispensing device is that water can easily enter the dispensing device through the one or more discharge openings, in particular when the dispensing device is held under a water jet for cleaning.

Another drawback of the known dispensing device is that, because of the presence of the protective outer wall, the distance which has to be bridged by the hand of the user during operation is increased, which makes it more difficult to operate the dispensing device or makes the stroke to be performed during the operation of the actuating head appreciably smaller. The term distance to be bridged is understood to mean the distance between the retaining section where the dispensing device is generally held between the thumb and a number of fingers, and the upper side of the actuating head which is pressed down during operation by the index finger.

SUMMARY OF THE INVENTION:

It is an object of the invention to provide a dispensing device which solves at least one of the abovementioned drawbacks.

According to a first aspect of the invention, the invention provides a dispensing device which is characterized by the one or more discharge openings discharging over a section of at most 180 degrees, preferably at most 90 degrees, of the periphery of the dispensing device.

By only arranging discharge openings on a limited section of the periphery of the dispensing device, the risk of water ingress and thus of harmful substances, such as for example a water/soap mixture, is greatly reduced. With such an embodiment, the user can rinse the dispensing device under a water jet in order, for example, to remove remains of soap from the outside of the dispensing device, without water entering the dispensing device, by turning the dispensing device to a position in which the discharge openings are turned away from the water jet.

Advantageously, the dispensing device comprises one discharge opening which preferably discharges into a section of at most 60, more preferably at most 30 degrees, of the periphery of the dispensing device. Using a dispensing device which is designed in this manner further reduces the risk of the ingress of water through the discharge opening. However, advantageously it is also possible to provide a plurality of discharge openings in said area of 60 degrees, preferably at most 30 degrees.

With a dispensing device according to the invention which is to be held in the hand during operation, the one or more discharge openings are preferably provided under the dispensing opening of the actuating head. The expression under the actuating head is understood to mean at the same radial angle with respect to the longitudinal centre axis of the dispensing device. This is advantageous as a user will generally tilt the dispensing device forwards at a certain angle during dispensing in the direction of the dispensing opening. By positioning the one or more dispensing openings as indicated, these will automatically come to lie lower, as a result of which any water present in the space will easily run away.

With a dispensing device which is not held in the hand during operation, it is advantageous to position the one or more dispensing openings on the side of the dispensing device which is situated opposite the dispensing opening of the actuating head. By arranging the one or more discharging openings on the side remote from the dispensing opening, the dispensing device will have a more attractive appearance not only on shop shelves, but also during use, as said side is usually the rear side of the dispensing device.

Examples of said dispensing devices which are not held in the hand during operation include, for example, foam or soap dispensers which are placed on a wash basin or on a work top, or in an appropriate hole in, for example, a wash basin or in a work top next to the kitchen sink. With the last-mentioned type, it may also be advantageous to position the one or more discharge openings exactly on the side of the discharge opening, since leak water will then leave the dispensing device on the side of the wash basin or kitchen sink.

It should be mentioned that with some dispensing devices, it is, for example, possible to turn the actuating head by a quarter turn in order to lock the actuating head. In such a locked state, the position of the one or more discharge openings with respect to the dispensing opening will thus also change. However, the preferred position of the one or more discharge openings is described with respect to the location of the dispensing opening during operation.

In an alternative embodiment, the dispensing device comprises a fixing collar with an internal screw thread for coupling the dispensing assembly to the liquid container, the one or more discharge openings extending through the fixing collar and discharging on the side of the internal screw thread.

In an embodiment of this type, there are no discharge openings whatsoever present on the outside of the dispensing device, which gives the dispensing device a more attractive appearance.

Advantageously, an edge of the protective outer wall along which the protective cap of the actuating head is guided, is provided with an upright wall which is turned away from the liquid container. The expression turned away from the liquid container is understood to mean in the direction of the upper side of the actuating head. The upright wall can have two functions. A first function of the upright wall is that, to a large degree, it "scrapes off" water which is on the outside of the protective cap, in particular at the downward stroke of the actuating head during operation of the pump (or pumps). A second function of the upright wall is that it further prevents water which is present on the protective outer wall from running into the space.

In a preferred embodiment of the dispensing device, at least one preferably substantially vertical wall protruding into the space and directed towards the liquid container is arranged on the protective outer wall, which vertical wall, at least in an area of the one or more discharge openings, extends at least halfway into the space, preferably nearly to the bottom of the space. By fitting such a wall, the ingress of water into the space through the one or more discharge openings is further prevented.

Preferably, the wall protruding into the space is fitted near an edge of the protective outer wall along which the protective cap is guided.

Advantageously, the actuating head is provided with a wall which protrudes outwards over the protective cap, which wall preferably extends over at least a part of the protective outer wall. Such a protruding wall which acts as a kind of umbrella for the protective cap, to a certain degree protects the protective cap against water. This in turn prevents water from being transported into the space along with the protective cap. The protruding wall preferably extends along the entire periphery of the protective cap.

According to a second aspect, the invention provides a dispensing device which is characterized in that the retaining handle is formed by a retaining section of the protective outer wall of the dispensing device, which section is substantially vertical and/or tapers outwards in the direction remote from the liquid container.

With the dispensing devices according to the prior art, the protective outer wall is usually formed by a separate cover, the discharge opening being formed between the cover and the dispensing assembly. Furthermore, the covers are designed in such a way that they do not meet the criteria to serve as retaining handle.

In the embodiment according to the second aspect of the invention, the protective outer wall is designed to be sufficiently strong and of such a shape that it can serve as retaining handle. As a result of this option, the retaining handle is located in a much higher position compared to the known dispensing devices having a protective outer wall against the ingress of water, which makes the operation of the dispensing device easier and/or enlarges the stroke of the actuating head which the user can achieve.

According to the second aspect of the invention, the retaining section may run substantially vertically or taper outwards, but combinations thereof are also possible. The retaining section in principle only has to be fitted on two opposite parts of the dispensing device and thus not on the entire periphery thereof.

Advantageously, the dispensing device comprises a fixing collar for fastening the dispensing assembly to the liquid container, at least the retaining section of the protective outer wall being integrally formed with the fixing collar. By integrally forming the fixing collar and the protective wall, the retaining handle can be given additional strength, as a result of which it can fulfil its retaining function even better.

In a preferred embodiment, the fixing collar comprises a section with an internal screw thread for coupling the dispensing assembly to the liquid container, the one or more discharge openings discharging above the section provided with the internal screw thread. By providing the discharge openings above the section provided with the internal screw thread, it is possible to make the dispensing device of relatively narrow design. This relatively narrow design of the dispensing device was not more attractive with the known dispensing device as the retaining handle was at the level of the internal screw thread, which would have resulted in leak water flowing out of the discharge openings over the hand of the operator.

Advantageously, the protective outer wall comprises an essentially outwardly protruding flange at the end of the retaining section remote from the liquid container. With such a flange which is arranged just above the retaining section, the user can hold the dispensing device in his/her hand easily since the dispensing device rests on the hand, in particular on the fingers, of the user because of the presence of the flange. Thanks to the flange, the user does not need to exert so much force on the dispensing device in order to hold it.

It should be noted that the individual measures which have been described above and in the dependent claims in connection with one of the two aspects of the invention can also be applied in an embodiment according to the other aspect of the invention. Such applications are considered to be within the scope of the invention.

BRIEF DESCRIPTION OF THE DRAWINGS

The invention will be explained in more detail below with reference to the accompanying drawing, in which:

FIG. 3*a* shows a cross section through an alternative embodiment of a dispensing assembly according to the invention, and FIG. 3*b* shows a detail of a part of FIG. 3*a*.

DETAILED DESCRIPTION OF PREFERRED EMBODIMENTS

Figure 1:
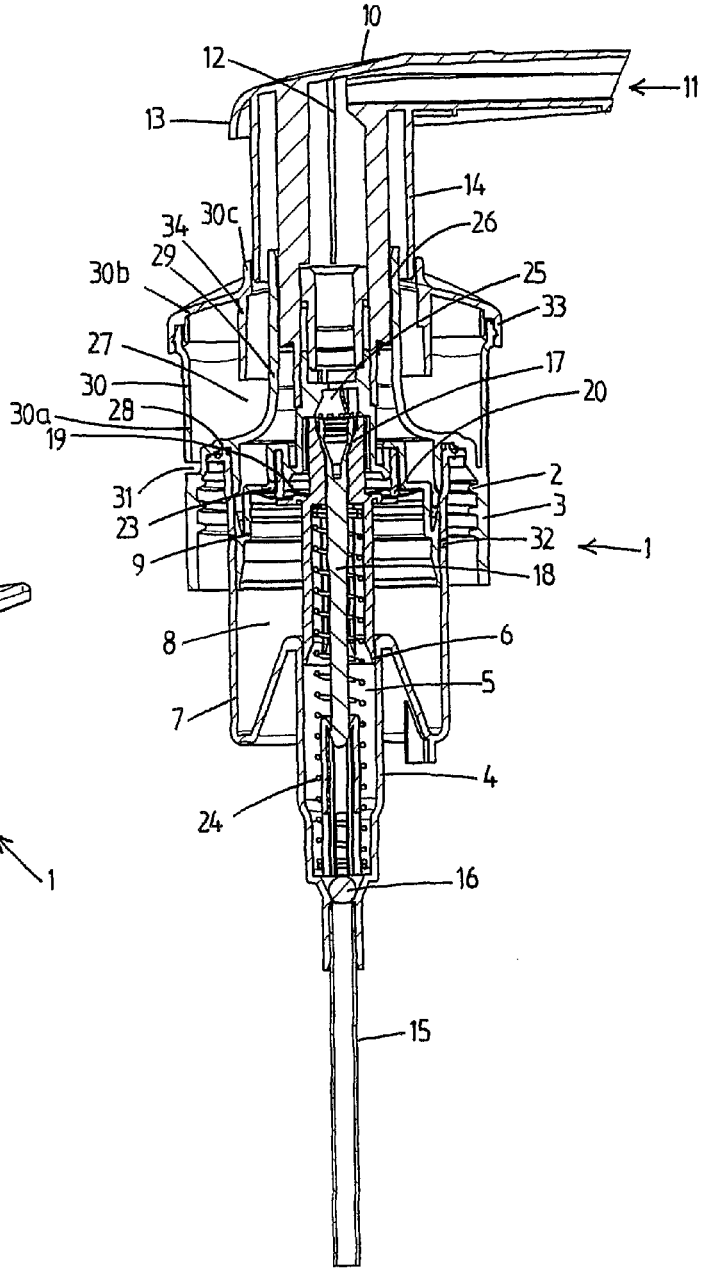
FIG. 1 shows a cross section of a dispensing assembly of a dispensing device according to both aspects of the invention.

FIG. 1 shows a dispensing assembly 1 for dispensing foam. The dispensing assembly 1 can be coupled in a liquid-tight manner to a liquid container by means of a screw thread section 2 of a fixing collar 3. Such an assembly of liquid container and dispensing assembly 1 results in a dispensing device for dispensing foam.

Figure 2:
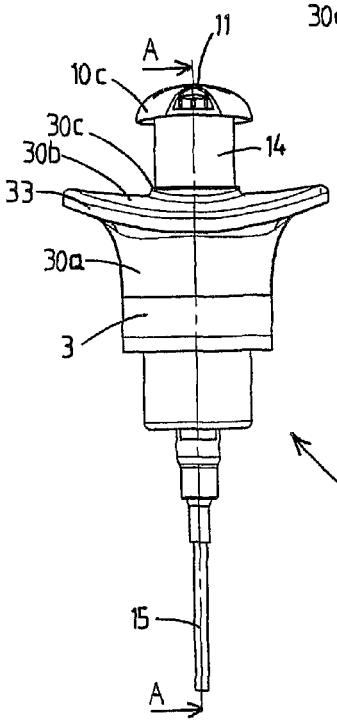
FIG. 2 shows a side view of the dispensing device of FIG. 1.

FIG. 2 shows a side view of the dispensing assembly 1 from FIG. 1, the dispensing assembly 1 being turned a quarter turn about the longitudinal centre axis A-A of the dispensing assembly 1 relative to FIG. 1.

The dispensing assembly 1 comprises a liquid pump 4 having a liquid pump chamber 5 and a liquid pump piston 6. In addition, there is an air pump 7 having an air pump chamber 8 and an air pump piston 9. Both pistons 6 and 9 are coupled to an actuating head 10.

The actuating head 10 comprises a dispensing opening 11 and a discharge duct 12. The actuating head 10 furthermore comprises a circular protective cap 14. Above the protective cap 14, the actuating head 10 comprises an outwardly protruding wall 13, whose function will be described below.

Reference numeral 15 denotes a riser which nearly reaches as far as the bottom of a liquid container 2 coupled to the dispensing assembly and serves as supply for the liquid pump 4. In addition, a non-return valve is present in the supply of the liquid pump 4 in the shape of a sphere 16. The discharge of the liquid pump 4 is situated at 17 and can be closed off by means of rod-shaped non-return valve component 18.

The discharge of the liquid pump 7 is located at 19. Reference numeral 20 denotes a flexible sealing component which comprises two annular resilient sealing lips which serve for closing off and opening the supply and discharge of the air pump 7, respectively.

The dispensing assembly 3 furthermore comprises reset means which comprise a spring 24.

When using the foam former, the actuating head 10 can be pressed which moves the pistons 9 and 6 of the air pump 7 and the liquid pump 4, respectively, downwards, as a result of which the relevant piston chambers 8 and 5, respectively, are reduced in volume and air and liquid are dispensed to a mixing chamber 25. In the latter, air and liquid are mixed and the mixture is subsequently passed through two small screens in the discharge duct 12 and leaves the dispensing opening 11 in the form of a foam.

Once the foam has been dispensed, the actuating head 10 is released and will move back to its starting position due to the spring 24. During this movement, the non-return valve 16 will open and the liquid pump chamber 5 will fill with the liquid from the liquid container 2, while the air pump chamber will fill with air.

Reference numeral 32 denotes an aeration opening for the liquid container 2, which serves for supplying air to the interior of the liquid container 2 in order to make up for the amount of liquid removed from the liquid container. Leak water could also end up in the liquid container 2 via this opening, which is, of course, undesirable.

The same is true for the air supply opening 23 of the air pump and the upper side of the air piston 9, as the presence of water, in particular when mixed with traces of soap, can significantly impede the action of the air pump.

It is clear from the figures that the air supply opening 23 of the air pump and the aeration opening 32 are only in communication with the environment via a gap 26 between the actuating head 10 and an inner wall 29. It is therefore undesirable for water to enter the dispensing assembly 1 via this gap 26. To this end, the dispensing device comprises measures to protect it against water and keep the water away from the gap 26, as will be described below.

The dispensing device comprises a circular space 27 with a bottom 28, a protective inner wall 29 and a protective outer wall 30. A single discharge opening 31 is provided in the bottom 28, which discharge opening 31 is in communication with the environment.

The protective outer wall 30 is substantially composed of three sections. The first section 30*a* runs vertically, i.e. substantially parallel to the longitudinal centre axis of the dispensing assembly 1 or runs slightly outwards in the direction of the upper side of the actuating head (see the view in FIG. 2). This section 30*a* serves as retaining handle for the hand of a user, in particular a number of fingers and a thumb, when operating the actuating head 10, which is usually effected with the index finger. As the section 30*a* runs parallel with the longitudinal centre axis or even outwards, this section 30*a* is suitable as retaining handle.

A second section 30*b* of the protective wall 30 runs horizontally in the direction of the longitudinal centre axis of the dispensing assembly 1 and forms an opening through which the protective cap 14 of the actuating head 10 is guided into the space 27. On the edge of the second section 30*b* forming the opening of the protective outer wall 30, a third section 30*c* of the protective outer wall 30 is arranged, which section 30*c* forms an upright wall which prevents water from entering through the opening into the dispensing assembly 1.

If now water possibly containing further contaminating components, such as for example traces of soap, flows onto the dispensing device from above, most of the water will be removed directly via the outside of the dispensing device as a result of the presence of the protruding wall 13 which acts as a kind of umbrella.

However, it is possible that some of the water ends up on the wall of the protective cap 14, for example when water hits the dispensing device from the side. As this protective cap 14 is guided into the space 27 during operation, this water has to be removed in an adequate manner.

A first measure for this purpose is the presence of the third section 30*c* of the protective outer wall 30 which partly "scrapes off" the water flowing down or the water entrained by the protective cap 14 and removed further via the outside of the protective outer wall 30.

However, it is still possible for water to flow into the space 27 via the protective cap 14. The protective inner wall 29 then forms a protection against water entering further into the dispensing assembly 1. To this end, the protective inner wall 29 extends upwards into the actuating head 10 beyond the uppermost end of the protective outer wall 30. Furthermore, the protective inner wall is shaped in such a manner that water which is present in the space 27 is guided to the discharge opening 31. The water in the space 27 is discharged via the discharge opening 31.

The discharge opening 31 extends over approximately 60 degrees of the periphery of the dispensing device 1. The advantage of a discharge opening 31 which only extends over a limited part of the periphery of the discharge assembly is that the ingress of water into the space 27 via the discharge opening 31 is rendered more difficult.

As the discharge opening 31 generally extends over an area of at most 180 degrees, preferably at most 90 degrees, of the periphery of the discharge assembly, the dispensing device can be rinsed under a water jet without water being able to enter the discharge opening 31 easily.

The discharge opening 31 discharges above the threaded section 2 of the fixing collar. As a result, the outer periphery of the dispensing device can be kept narrow, so that it can be held in the hand relatively easily, in particular also by individuals with relatively small hands.

The discharge opening 31 shown in FIG. 1 is located on the side of the dispensing assembly 1 which is opposite the dispensing opening 11 in the actuating head 10. This offers the advantage that this discharge opening is situated at the "rear" of the dispensing device and therefore does not adversely affect the front appearance of the dispensing device (see for example FIG. 2) as there is no opening in the front of the dispensing device 1.

Alternatively, the discharge opening 31 may also be provided in the area underneath the dispensing opening 11, i.e. at the same level as the discharge opening shown in FIG. 1, but on the right-hand side of the dispensing assembly as shown in FIG. 1. Such a position has the advantage that any water present in the space 27 can easily flow out of the dispensing device during operation of the dispensing device as the dispensing device is usually tilted in the direction of the dispensing opening during operation.

The second section 30*b* of the protective wall 30 is provided with a downwardly directed, substantially vertical wall 34. This vertical wall 34 forms an additional protection against water present in the space flowing further into the dispensing assembly. Advantageously, the vertical wall 34 may be designed such that it substantially extends nearly as far as the bottom of the space in an area of the one or more discharge openings. As a result, the ingress of water into the dispensing assembly 1 via the discharge opening 31 is prevented further.

As has been described above, the substantially vertical and outwardly extending section 30*a* of the protective outer wall 30 serves as retaining handle for holding the dispensing device during operation. To this end, the first section 30*a* is advantageously integrally formed with the fixing collar 3. This design gives the retaining handle additional strength. The remaining two sections 30*b* and 30*c* of the protective outer wall 30 are produced as a separate component together with the vertical wall 34. The separate component is connected to the first section 30*a* by means of a snap connection.

In order to improve the ease of handling of the dispensing assembly 1 further, the latter comprises a flange 33 which is provided on the upper end of the vertically and obliquely outwardly extending section 30*a* of the protective outer wall 30. This flange 33 provides additional help when holding the dispensing device as a user can easily allow the flange 33 of the dispensing assembly to rest on his hand, in particular a number of fingers and the thumb, without in this case having to exert a substantial pinching force on the retaining handle.

The flange 33 which runs substantially horizontally outwards, is of oval shape, with the two parts protruding the furthest being arranged at the location where the fingers and thumb hold the dispensing device during operation. It is also possible to design the flange so that it has a circular shape or another suitable shape.

The flange 33 is integrally formed with the separate component which comprises the second 30*b* and third 30*c* section of the protective outer wall 30 and the vertical wall 34.

Through the measures described above, the dispensing assembly 1 in particular provides good protection against the ingress of water into the dispensing assembly 1 while at the same time being easy to operate.

FIG. 3*a* shows an alternative embodiment of a dispensing assembly, denoted overall by the reference numeral 1. The components of this embodiment which have an identical function to those of the embodiment of FIGS. 1 and 2 are denoted by corresponding reference numerals.

The general operation and function of the components of the dispensing device of FIG. 3*a* corresponds to the operation of the dispensing assembly as described in connection with FIGS. 1 and 2.

One modification of the embodiment of FIG. 3 is that the discharge opening 31 passes through the fixing collar and discharges on the inside thereof. In order to show this more clearly, a section of FIG. 3*a* has been shown in more detail in FIG. 3*b*. This section is denoted in FIG. 3*a* by a rectangle of dashed lines.

The discharge opening 31 discharges at the top of the threaded section 2. In order to remove the water further in an easy manner, a slot in the longitudinal direction has been provided in the screw thread. In this embodiment, the water flows off between the fixing collar 3 and a liquid container coupled thereto. The path followed by the water flowing away is indicated in FIG. 3*b* by an arrow. The discharge opening 31 has the advantage that it is very difficult for water to flow from the outside through the discharge opening 31 to the space 27. Furthermore, this embodiment has the advantage that the discharge opening 31 is not visible from the outside, which gives the dispensing device a more attractive appearance.

Another modification compared to the dispensing assembly 1 from FIG. 1 is that the dispensing assembly 1 of FIG. 3 is provided with a second vertical wall 35 in the space 27, which extends almost as far as the bottom of the space. Such a wall 35 will further impede the flow of water from the discharge opening 31 into the dispensing assembly 1. The wall 35 is only fitted at the location of the discharge opening 31 and does therefore not extend over the entire periphery of the dispensing assembly 1, unlike the wall 34.

Such a second vertical wall 35 may also be of particular advantage in an embodiment according to FIG. 1, i.e. in an embodiment where the one or more discharge openings 31 discharge on the outside of the dispensing assembly 1. Such a vertical wall 35 largely prevents water from entering further into the dispensing assembly 1 via such discharge openings 31.

What is claimed is:

1. Dispensing device for dispensing a foam, comprising:

a liquid container and a dispensing assembly, the dispensing assembly comprising a liquid pump, an air pump and an actuating head, the actuating head comprising a discharge duct and a dispensing opening for dispensing the liquid, and a circular protective cap, which protective cap can be guided into a space which is formed between a protective inner wall and a protective outer wall of the dispensing assembly, wherein the protective outer wall is an outer wall of the dispensing device, wherein the dispensing device has a retaining handle for holding the dispensing device during dispensing, wherein the retaining handle comprises a retaining section of the protective outer wall of the dispensing device, which retaining section is substantially vertical or tapers outwards in the direction remote from the liquid container, wherein the dispensing device comprises a fixing collar for fastening the dispensing assembly to the liquid container, at least the retaining section of the protective outer wall being integrally formed with the fixing collar and extending upwardly from the fixing collar, wherein only one discharge opening is provided near the bottom of the space, which discharge opening is provided as a through-going hole going through a bottom end of the retaining section of the dispensing assembly and discharges to the outside of the dispensing device, and wherein the one discharge opening discharges over a section of at most 90 degrees of the periphery of the dispensing device.

2. Dispensing device according to claim 1, in which the one discharge opening discharges into a section of at most 30 degrees of the periphery of the dispensing device.

3. Dispensing device according to claim 1, in which the section with the one discharge opening is provided under the dispensing opening of the actuating head.

4. Dispensing device according to claim 1, in which the section with the one discharge opening is positioned on the side of the dispensing device which is situated opposite the dispensing opening of the actuating head.

5. Dispensing device according to claim 1, in which the dispensing assembly comprises an air pump having an air supply and an air discharge.

6. Dispensing device according to claim 5, in which the air pump and the liquid pump are designed as an assembly of two concentric piston pumps.

7. Dispensing device according to claim 1, in which an edge of the protective outer wall along which the protective cap is guided, is provided with an upright wall which is turned away from the liquid container.

8. Dispensing device according to claim 1, in which at least one substantially vertical wall protruding into the space and directed towards the liquid container is arranged on the protective outer wall, which vertical wall, at least in an area of the one discharge opening, extends at least halfway into the space, nearly to the bottom of the space.

9. Dispensing device according to claim 8, in which the wall protruding into the space is fitted near an edge of the protective outer wall along which the protective cap is guided.

10. Dispensing device according to claim 1, in which the actuating head is provided with a wall which protrudes outwards over the protective cap, which wall extends over the entire periphery of the protective cap.

11. Dispensing device for dispensing a foam, comprising:
a liquid container and a dispensing assembly,
the dispensing assembly comprising a liquid pump and an actuating head,
the actuating head comprising a discharge duct and a dispensing opening for dispensing the liquid, and a circular protective cap, which protective cap can be guided into a space which is formed between a protective inner wall and a protective outer wall of the dispensing assembly,
wherein one or more discharge openings are provided near the bottom of the space which discharge to the outside of the container,
the dispensing device having a retaining handle for holding the dispensing device during dispensing,
wherein the retaining handle is formed by a retaining section of the protective outer wall of the dispensing device, which section is substantially vertical or tapers outwards in the direction remote from the liquid container,
in which the dispensing device comprises a fixing collar for fastening the dispensing assembly to the liquid container, at least the retaining section of the protective outer wall being integrally formed with the fixing collar,
in which the fixing collar comprises an inner side with an internal screw thread for coupling the dispensing assembly to the liquid container,
the one or more discharge openings extending through the fixing collar and discharging at the inner side of the fixing collar above the internal screw thread.

12. Dispensing device according to claim 11, in which the protective outer wall comprises an essentially outwardly protruding flange at the end of the retaining section remote from the liquid container.

13. Dispensing device for dispensing a foam, comprising:
a liquid container and a dispensing assembly,
the dispensing assembly comprising a liquid pump and an actuating head,
the actuating head comprising a discharge duct and a dispensing opening for dispensing the liquid, and a circular protective cap, which protective cap can be guided into a space which is formed between a protective inner wall and a protective outer wall of the dispensing assembly,
wherein one or more discharge openings are provided near the bottom of the space, which one or more discharge openings discharge to the outside of the container, and
wherein the dispensing device comprises a fixing collar having an outer side and an inner side, said inner side being provided with an internal screw thread for coupling the dispensing assembly to the liquid container, the one or more discharge openings extending through the fixing collar and discharging on the inner side of the fixing collar above the internal screw thread.

14. Dispensing device for dispensing a foam, comprising:
a liquid container and a dispensing assembly,
the dispensing assembly comprising a liquid pump, an air pump and an actuating head,
the actuating head comprising a discharge duct and a dispensing opening for dispensing the liquid, and a circular protective cap, which protective cap can be guided into a space which is formed between a protective inner wall and a protective outer wall of the dispensing assembly,
wherein the protective outer wall is an outer wall of the dispensing device,
wherein one or more discharge openings are provided near the bottom of the space which one or more discharge openings discharge to the outside of the dispensing device,
the dispensing device having a retaining handle for holding the dispensing device during dispensing,
wherein the retaining handle is formed by a retaining section of the protective outer wall of the dispensing device, which retaining section is substantially vertical or tapers outwards in the direction remote from the liquid container, and
wherein the dispensing device comprises a fixing collar for fastening the dispensing assembly to the liquid container, at least the retaining section of the protective outer wall being integrally formed with the fixing collar and extending upwardly from the fixing collar,
wherein the one or more discharge openings are provided as one or more through-going holes at a transition between the retaining section and the securing collar and wherein the one or more discharge openings discharge over a section of at most 180 degrees of the periphery of the dispensing device.

* * * * *